US005315103A

United States Patent [19]

Raverdy et al.

[11] Patent Number: 5,315,103

[45] Date of Patent: May 24, 1994

[54] RADIOLOGICAL IMAGE INTENSIFIER TUBE WITH DYED POROUS ALUMINA LAYER

[75] Inventors: Yvan Raverdy, Bas Bernin; Christian Marillat, Saint Egreve; Daniel Gally, Grenoble, all of France

[73] Assignee: Thomson Tubes Electroniques, Velizy, France

[21] Appl. No.: 966,510

[22] Filed: Oct. 23, 1992

[30] Foreign Application Priority Data

Oct. 31, 1991 [FR] France ..... 91 13487

[51] Int. Cl.[5] ..... H01J 40/14

[52] U.S. Cl. ..... 250/214 VT; 313/543

[58] Field of Search ..... 250/214 VT, 390.11; 313/524, 530, 543

[56] References Cited

U.S. PATENT DOCUMENTS

| | | | |
|---|---|---|---|
| 3,609,359 | 9/1971 | Weiner | 250/214 VT |
| 3,891,852 | 6/1975 | Bollen et al. | 250/390.11 |
| 4,062,009 | 12/1977 | Raverdy et al. . | |
| 4,069,121 | 1/1978 | Baud et al. . | |
| 4,437,035 | 3/1984 | Raverdy et al. . | |
| 4,931,693 | 6/1990 | Gally et al. . | |
| 5,146,076 | 9/1992 | Raverdy et al. . | |

FOREIGN PATENT DOCUMENTS

| | | |
|---|---|---|
| 0319080 | 6/1989 | European Pat. Off. . |
| 1557119 | 12/1967 | France . |

OTHER PUBLICATIONS

Patent Abstracts of Japan, vol. 6, No. 52 (E-100)(930), Apr. 7, 1982, & JP-A-56 165 251, Takashi Noji, "Input Surface of X-ray Image Intensifier and its Manufacturing Method."

Patent Abstracts of Japan, vol. 13, No. 207 (E-758)(3555), May 16, 1989, & JP-A-1 024 343, Shozo Sato, "X-ray Image Tube and its Manufacture."

*Primary Examiner*—David C. Nelms

*Attorney, Agent, or Firm*—Oblon, Spivak, McClelland, Maier & Neustadt

[57] ABSTRACT

The disclosure relates to radiological image intensifier tubes, and more particularly to means to improve the image resolution of these tubes and/or correct their brightness curve at output. The image intensifier tube comprises an input screen comprising a scintillator borne by an aluminium substrate. A porous layer of alumina is interposed between the scintillator and the substrate. The alumina layer is dyed so as to absorb the light emitted by the scintillator towards the substrate.

15 Claims, 4 Drawing Sheets

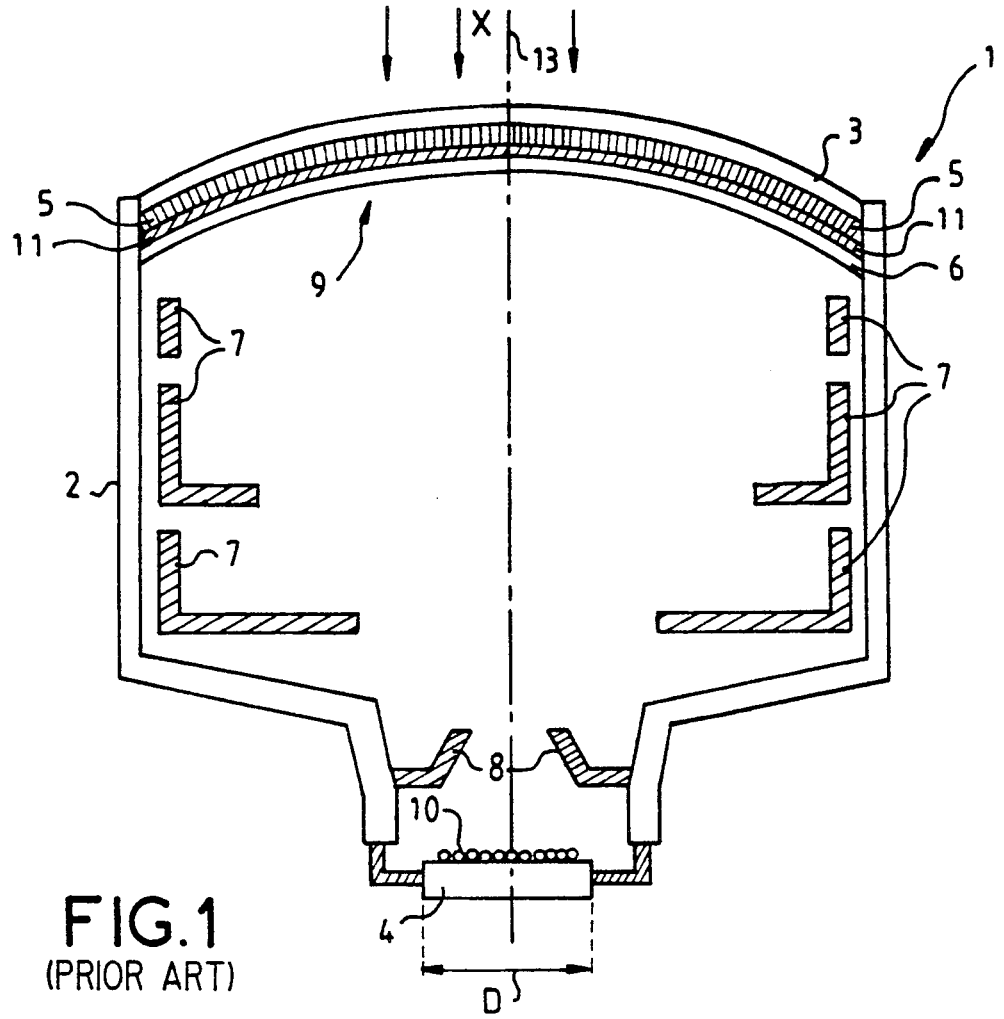
FIG.1
(PRIOR ART)
FIG.2
(PRIOR ART)
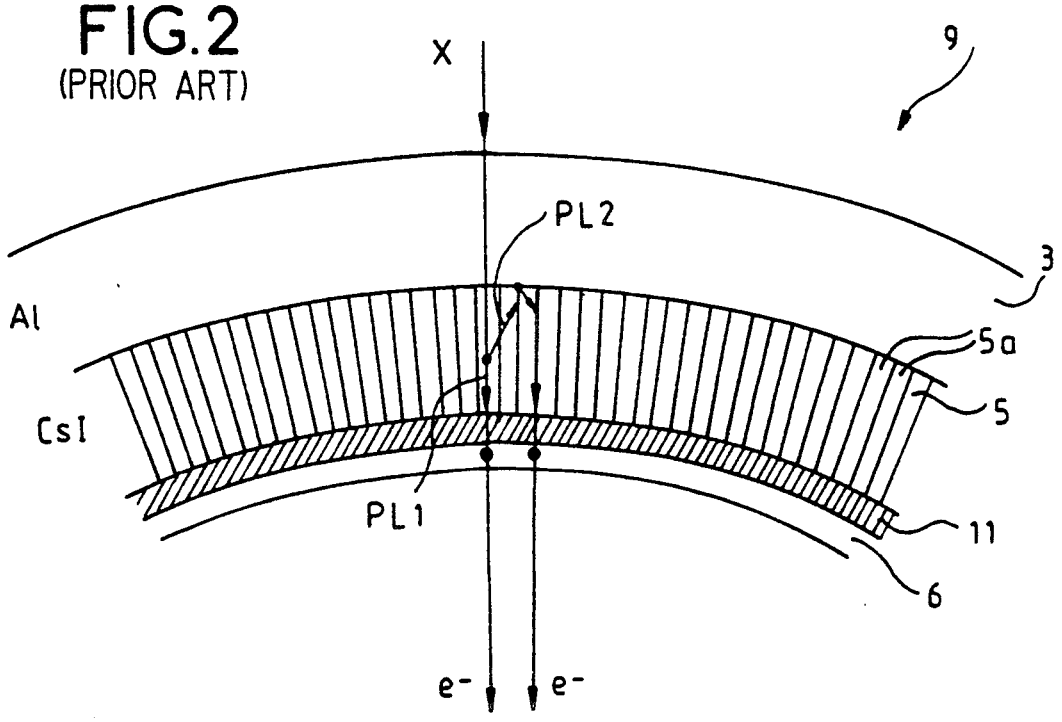

RADIOLOGICAL IMAGE INTENSIFIER TUBE WITH DYED POROUS ALUMINA LAYER

BACKGROUND OF THE INVENTION

1. Field of the Invention

The invention relates to radiological image intensifier tubes, and more particularly to means for improving the image resolution of these tubes.

2. Description of the Prior Art

An image intensifier tube is a vacuum tube comprising an input screen, located at the front of the tube, an electronic optical system and a screen for the observation of the visible image located at the rear of the tube, on the same side as an output window of this tube.

In X-ray or radiological image intensifier tubes, the input screen furthermore has a scintillator screen which converts the incident X photons into visible photons.

FIG. 1 gives a schematic view of a radiological type of image intensifier tube such as this.

The radiological image intensifier tube 1 comprises a glass envelope 2, one end of which, at the front of the tube, comprises an input screen 3 exposed X photon radiation.

The second end of the envelope forming the rear of the tube is closed by an output window 4 transparent to light.

The X-rays are converted into light rays by a scintillator screen 5. The light rays excite a photocathode 6 which produces electrons in response.

The electrons produced by the photocathode 5 are accelerated towards the output window 4 by means of different electrodes 7, and by an anode 8 positioned along a longitudinal axis 13 of the tube and forming the electronic optical system.

The output window 4 is formed by a transparent glass part which, in the example shown, bears a cathodoluminescent screen or output screen 10, made of luminophores for example.

The impact of the electrons on the cathodoluminescent screen or output screen 10 makes it possible to reconstitute an image (amplified in luminance) which was initially formed on the surface of the photocathode 6.

The image displayed by the output screen 10 is visible through the glass part which constitutes the output window 4. Generally, optical sensor devices (not shown) are positioned outside the tube in the vicinity of the output window 4 to pick up this image through the window 4 and enable it to be observed.

In the most recent observations, the input screen 9 comprises an aluminium substrate covered by the scintillator 5, itself covered by an electrically conductive and transparent layer 11, made of indium oxide for example. The photocathode is deposited on this transparent layer 11.

The X-rays strike the input screen on the aluminium substrate side. They go through this substrate and then reach the material constituting the scintillator.

The light photons produced by the scintillator are emitted in about every direction. However, to increase the resolution of the tube, the scintillator material chosen is generally a substance such as caesium iodide (CsI) which has the property of growing in the form of crystals perpendicular to the surface on which they are deposited. The needle crystals thus deposited tend to guide the light perpendicularly to the surface, which favors high image resolution.

The French patent application No. 88.09938 dated Jul. 22, 1988 describes the way to improve this resolution by reducing the mean cross-section of the needle crystals of the scintillator, through the surface condition of the layer on which the scintillator is made to grow.

The quality of the image resolution may also be lowered because light photons generated in the scintillator start off again towards the side on which the X-rays arrive. These photons strike the aluminium substrate with an incidence that is random. They are reflected by the aluminium substrate frontwards, hence towards the photocathode, but the path of these photons is such that the result is a loss of resolution: for a same X-photon incidence, it is possible to arrive at a situation where electrons are created at points in the photocathode that are different from those required.

FIG. 2 gives a view, in greater detail, of the input screen 9 and illustrates this loss of resolution by showing, side by side, the different paths followed by two light photons PL1, PL2 arising out of the impact of an X photon on the scintillator 5, resulting in the formation of electrons at different points of the photocathode. The input window 3, through which the X-rays arrive, constitutes the aluminium substrate bearing the cesium iodide scintillator 5, the crystals 5a of which are perpendicular to the surface and tend to channel the light photons. The transparent conductive sub-layer referenced 11 is positioned between the scintillator 5 and the photocathode 6.

In the example shown in FIG. 2, the light photon PL2 is emitted backwards, i.e. towards the substrate 3, with an incidence such that it is reflected by the substrate towards the photocathode 6, the path that it takes in the scintillator 5 being a needle crystal different from the one in which it has been generated: this fact illustrates the loss of resolution.

SUMMARY OF THE INVENTION

The present invention proposes an improvement in image resolution by the reduction of the quantity of light photons that are reflected by the substrate after having been emitted backwards.

To this end, the invention shows a way to interpose, between the aluminium substrate and the scintillator, a screen at least partially absorbing the light produced in the scintillator.

According to the invention, it is proposed to make a radiological image intensifier tube in which the input screen comprises, between the scintillator and the substrate bearing this scintillator, an alumina layer "tinted" or "dyed" by means of a substance that is absorbent at the wavelength emitted by the scintillator so that the light photons emitted by the scintillator towards the substrate are at least partially absorbed in this dyed alumina layer.

In absorbing at least a part of the light photons emitted backwards, a reduction is achieved in the proportion of these photons which, after reflection by the substrate, strike the photocathode at points very different from those struck by the light photons that are emitted frontwards and generated by same X photons.

The expression "dyed by a substance absorbent at the wavelength emitted by the scintillator" is used to define a substance capable of opacifying the alumina that contains it or is impregnated with it, i.e. of reducing its transmission, at least for the wavelength emitted by the scintillator. Consequently, the term "dyed" can be applied also to a neutral or gray color or hue capable of absorbing a wider range of wavelengths.

In the most common example, where the substrate is made of aluminium and the scintillator is made of cesium iodide, the dyed alumina layer furthermore has the very major advantage of promoting the adherence of the scintillator to the aluminium substrate.

Furthermore, the advantage of an approach such as this is that it remains compatible with the reduction of the section of the needle crystals of the scintillator.

The dyed alumina layer may be made by several methods: for example a method of vacuum co-evaporation that is conventional per se; or again by an anodization of the substrate. The anodization of the substrate may be done according to a method suited to making the alumina layer porous, and the anodization is followed by a step for the filling of the pores with a substance that is absorbent at the wavelength emitted by the scintillator.

This absorbent substance may be deposited on the internal walls of the pores by a dip-coating method using an appropriate solution to give the coloring suitable to absorb the light produced by the scintillator.

The absorption coefficient given to the alumina layer may be controlled, for example, by the concentration of the solution in colored product and/or by the degree of porosity of the alumina layer.

Furthermore, by modifying the coefficient of absorption of the dyed alumina layer, between its edges and the center, it is possible to make this variation of the absorption coefficient correspond to a law that is suited, for example, to correcting the brightness curve of the radiological image intensifier tube.

It should also be noted that, by controlling the degree of porosity of the alumina layer, it can be given a structure better suited to bearing the scintillator layer and withstanding the effects of the differences in heat expansion coefficient between itself and the scintillator layer.

BRIEF DESCRIPTION OF THE DRAWINGS

The invention will be understood more from the following description, made with reference to the appended figures, of which:

FIG. 1, already described, shows a schematic view of a standard image intensifier tube;

FIG. 2 already described shows a schematic sectional view of the details of a part of an input screen shown in FIG. 1;

DETAILED DESCRIPTION OF THE INVENTION

Figure 3:
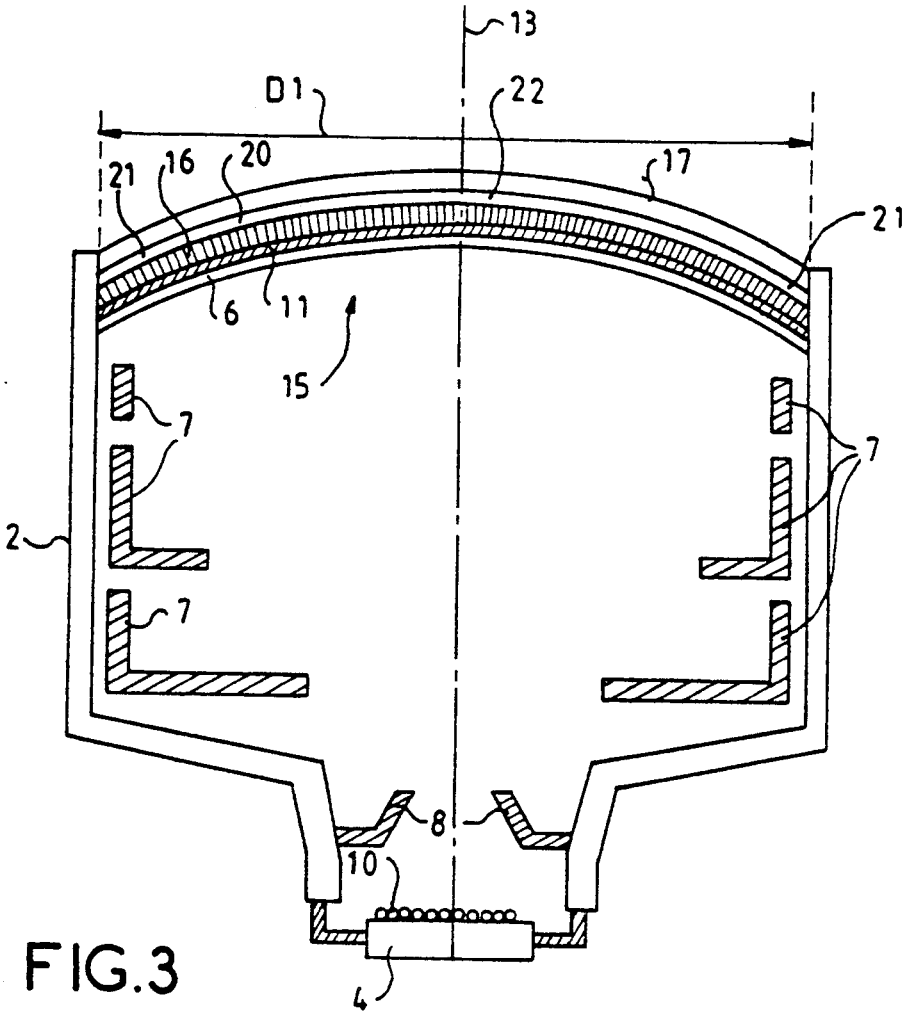
FIG. 3 shows a schematic sectional view of an input screen of a radiological image intensifier tube according to the invention.

FIG. 3, by means of a view similar to that of FIG. 1, shows a radiological image intensifier tube comprising an input screen 15 according to the invention, the radiological image intensifier tube being, as it happens, similar to that shown in FIG. 1.

The input screen 15 comprises a scintillator layer 16 borne by a support or substrate 17. The substrate 17 is preferably constituted by an aluminium foil, but it may also be an aluminium-based alloy. Its thickness (which is for example of the order of half a millimeter) gives it appropriate transparency to X-rays.

The scintillator layer 16 is itself a standard one, for example made of cesium iodide with a thickness of a few hundreds of microns (of the order of 400 microns). The cesium iodide is doped, for example with sodium, so that it emits at a wavelength of about 4,300 angstroms (blue light), a wavelength that may vary with the doping of iodide. It must be noted that, in order to make FIG. 3 clearer, the proportion between the dimensions of the different elements has not been maintained in this figure.

The input screen 15 furthermore conventionally includes an electrically conductive transparent layer 11 borne by the scintillator layer 16 opposite the substrate 17, as well as a layer that forms the photocathode 6 and is deposited on the transparent layer 11.

According to one characteristic of the invention, the input screen 15 comprises a dyed alumina layer 20 interposed between the scintillator layer 16 and the substrate 17.

The dyed alumina layer 20 is designed notably to constitute a screen that is absorbent at the wavelength emitted by the scintillator 16, so as to achieve at least partial absorption of the light photons emitted by the scintillator 16 backwards, namely towards the substrate 17. To this effect, the alumina layer 20 is dyed by a substance capable of absorbing at least the light emitted by the scintillator 16, namely the blue light in this example.

The coefficient of absorption by the alumina layer 20 or, conversely, the transmission coefficient of this layer, at the wavelength emitted by the scintillator layer 16, depends on the quantity and concentration of the absorbent substance contained in this alumina layer. In a standard way, the absorption produced by the alumina layer 20 should be a compromise between, on the one hand, the acceptable loss in terms of light energy (light produced by the scintillator 16) hence the sensitivity and, on the other hand, the desired level of image resolution on the other.

According to another characteristic of the invention, the absorption coefficient (at the wavelength emitted by the scintillator 16) of the dyed alumina layer 20 varies between the external edges 21 and the central zone 22 of this layer, i.e. along a diameter D1 common to this layer 20, and the entire screen 15.

By giving the alumina layer 20 an absorption coefficient that increases from the edges 21 to the center 22, there is simultaneously obtained, by means of this alumina layer 20, both an improvement of the image resolution and a compensation of the brightness curve measured along a diameter D (shown in FIG. 1) of the output tube 10 of a radiological image intensifier tube. The brightness curve represents the light intensity at each point of the diameter of the output screen.

For reasons of electronic optics, the surface of an input screen of a radiological intensifier image is not plane but rounded; it may be parabolic or hyperbolic (for large-sized screens) or more generally shaped like a spherical cap.

The result of this curvature of the screen is that if the input screen is illuminated by a uniform beam of X-rays, the electronic density generated by the screen is not uniform. If the brightness curve is measured along the diameter D of the output screen 10 (FIG. 1), it is observed that this curve is not horizontal; it is generally shaped like the arc of a circle flattened at the center; the brightness of the output screen is the maximum towards the center but diminishes substantially as the edges are approached. For small-sized tubes (input screen with a diameter of 15 cm for example) the decrease in brightness at the edges with respect to the center is of the order of 25%. For screens of greater size (with a diameter 30 centimeters for example), the decrease reaches 35%.

An input screen 15 according to the invention, as shown in FIG. 3, makes it possible to improve the homogeneity of the brightness by giving a non-homogeneous distribution to the absorption, achieved by the dyed alumina layer 20, of the wavelength emitted by the scintillator.

Figure 4:
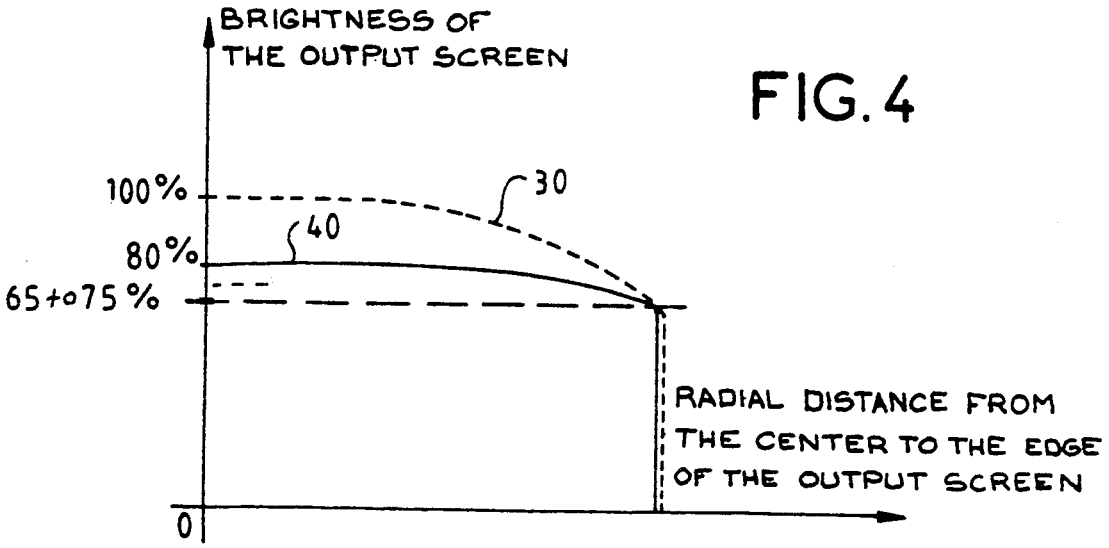
FIG. 4 shows brightness curves measured at output of a radiological image intensifier tube.

FIG. 4 shows a first curve and a second curve 30, 40 of radiological image intensifier tube brightness, plotted along a diameter of the output screen: they represent the brightness of a line of dots of the visible image on the output screen as a function of the distance of these dots from the center of the screen, in assuming that the illumination of the input screen is uniform.

Thus, the radial distance from the center has been shown on the x-axis and the brightness of the visible output image has been shown on the y-axis.

The first brightness curve 30 shown in dashes is a standard brightness curve obtained with a standard radiological image intensifier tube.

It is seen that this first brightness curve 30 is not a horizontal straight line or even almost a horizontal straight line as might be theoretically desirable. It is rather a sort of an arc of a circle flattened towards the center. The difference in brightness between the center and the edges ranges from 25% to 35% depending on the types of tubes and their diameter. In fact, a certain difference in brightness may be desirable, but not as great as this.

The second brightness curve 40 is obtained with the dyed alumina layer 20 interposed between the substrate 17 and the scintillator layer 16 (shown in FIG. 3). It is observed that since absorption by the layer 20 is greater towards the center 22 than towards the edges 21, this layer makes it possible to obtain a far flatter brightness curve wherein the difference between the center and the edges is limited to about 10% .

It is clear that by giving the dyed alumina layer 20 the appropriate absorption profile, it is possible to obtain a brightness curve with the desired profile.

It must be noted, however, that the absorption by the dyed alumina layer 20, namely the attenuation in the transmission of blue light achieved by this alumina layer, should take account of the fact that the light photons emitted backwards, such as the light photon PL2 shown in FIG. 2, undergo this attenuation twice: a first time to reach the substrate and a second time when they start again frontwards.

It should be furthermore noted that an effect which is particularly favorable for the improvement of the image resolution comes from the fact that the light photons which strike the substrate and return to the scintillator undergo a double attenuation which is all the greater as these photons are inclined with respect to the normal to their point of incidence on the substrate, because they travel through a greater distance in the attenuator medium.

To improve the resolution of the image, the absorption or attenuation by the dyed alumina layer 20 may be homogeneous along its diameter D1. However, the zone of the image in which the best resolution is generally sought is the central zone, in such a way that the improvement of the resolution and the compensation of the brightness curve may be obtained simultaneously by a same alumina layer 20.

The dyed alumina layer 20 may be made in different ways. It may be made, for example, by a so-called vacuum co-evaporation method. In this method, a simultaneous vacuum evaporation is carried out, firstly, of alumina (to form the alumina layer) and, secondly, of the opacifying product designed to "dye" the alumina layer, i.e. give it absorbent power with respect to wavelengths emitted by the scintillator 16.

In the case of a scintillator 16 emitting in the blue range, the opacifying product may be a metal element, such as chromium for example, or a compound substance such as, for example, silicon monoxide.

The technique of vacuum co-evaporation is a standard one. It is used notably to make thin or thick layers of composite materials, for example ceramic compositions having for example electrical or electro-optical characteristics.

The drawbacks of this method include notably the fact that it does not provide for easy control over of the surface condition of the layer.

According to a preferred embodiment of the invention, the dyed alumina layer 20 is a porous layer, the pores of which contain the substance that absorbs the wavelength emitted by the scintillator 16. The dyed alumina layer 20 is then a so-called "thick" layer (with a thickness ranging, for example, from 1 to 15 microns) as opposed to thin and dense layers (with a thickness of less than one micron).

The porous alumina layer 20 may be obtained simply, by the anodization of an internal face 30 of the aluminium substrate 17 in an appropriate acid medium. At this stage, the alumina layer 20 is porous and practically transparent, and it should be "dyed" by an opaque substance so that it acquires its "absorbent" property.

Figure 5:
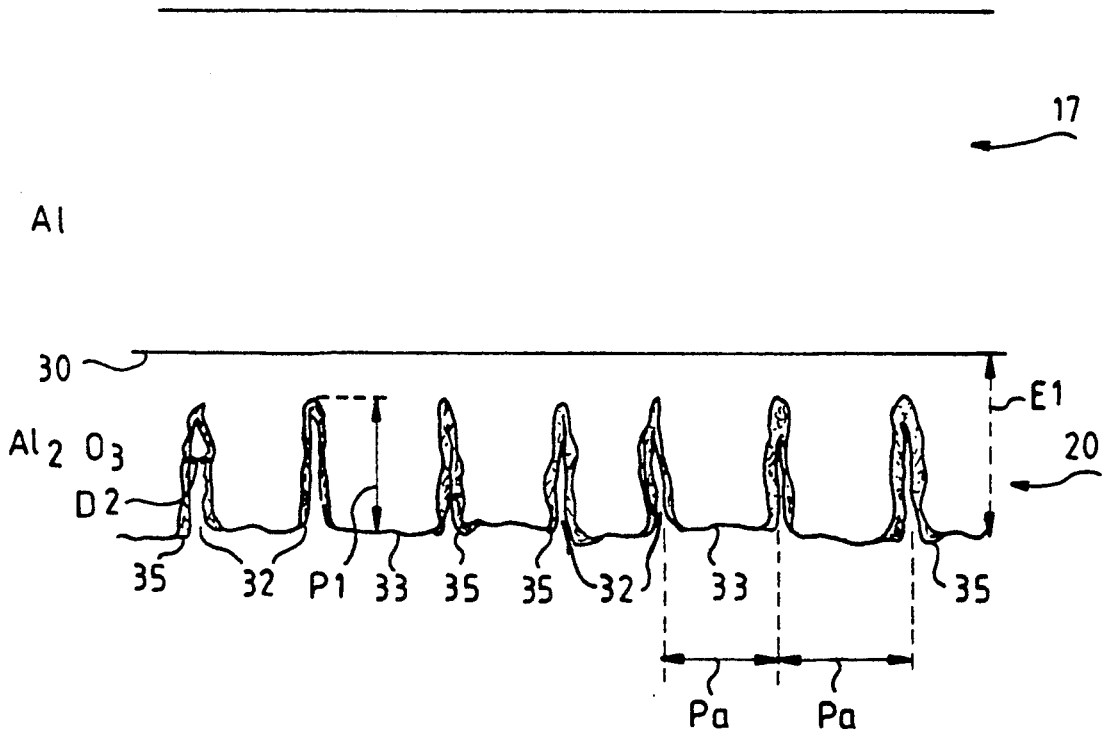
FIG. 5 shows a schematic sectional view of the details of a part of an alumina layer shown in FIG. 3.

FIG. 5 shows a schematic sectional view of a part of the screen 15, more particularly showing the alumina layer obtained by anodization of the substrate 17 in an acid medium according to a method that is standard per se. At this stage, the scintillator layer has not yet been deposited on the alumina layer 20.

This acid medium may be, for example, a solution of sulphuric acid in a proportion of about 15% by weight; or a solution of phosphoric acid in a proportion of 5% by weight, or a solution of oxalic acid in a proportion of 2% by weight etc.

The thickness E1 of the porous alumina layer 20 depends in a conventional way notably on the density of the anodic current, the temperature of the acid bath and the duration of the operation.

The densities of anodic current may vary for example between 1 and 2 amperes per $dm^2$. These operations are generally carried out at ambient temperature.

Under these conditions, it is easy to make an alumina layer 20, such as the one shown in FIG. 5. The alumina layer 20 is formed on the internal face 30 of the aluminium substrate 17, and the layer 16 forming the scintillator (not shown in FIG. 5) is then deposited on the alumina layer 20.

The alumina layer 20 comprises pores 32 forming channels, the general orientation of which is substantially perpendicular to the substrate 17. These pores 32 or channels start from the surface 33 of the layer 20 (on the side designed to receive the scintillator 16) and they have a mean depth P1 that is slightly smaller than the mean thickness E1 of the alumina layer 20: for example a mean depth P1 of the order of 7.5 microns for a mean thickness E1 of the order of 10 microns, and a mean diameter D2 of the order of 0.05 microns.

The degree of porosity of the alumina layer 20, namely the number of pores 32 and hence the mean pitch Pa of these pores, may be controlled in different ways, chiefly by the density of the anodic current. In the case of the above-mentioned example, where the mean depth P1 is of the order of 7.5 microns, with a mean thickness E1 of the order of 10 microns, it is possible to obtain a mean distance between two pores of the order of 2 to 3 microns. This can be done, for example, by regulating the current density since the porosity increases with the current density. Naturally, the characteristics of the porosity (the number and diameter of the pores 32) can be controlled also by the nature and concentration of the acid used.

It is also possible to control the condition of the surface 33 of the alumina layer 20 and give it a degree of roughness that provides for efficient gripping of the scintillator layer 16 and is suited to the growing of the needle crystals that constitute this layer with a cross-section that contributes to improving the image resolution. This may be obtained; for example, by regulating the conditions of anodization or the initial surface condition of the aluminium.

The porous alumina layer 20 is then easily "dyed" by means of standard methods such as those used notably for the decoration of aluminium, for example by a dip-coating method with a view to the deposition, on the walls of the pores 32, of the absorbent substance shown in the example in the form of a layer 35:

a) The dip-coating process may consist, for example, in a treatment of the alumina layer 20 in a solution of ferric oxalate in a proportion of 20% by weight. This treatment gives a yellow-orange color, capable in the example of absorbing the light produced by the scintillator 16.

b) Another method, well known in the art of aluminium decoration, consists in a treatment by means of a cobalt acetate solution of about 20 grams per liter at about 50° C., this treatment being followed by a second treatment by a solution of potassium permanganate, in a proportion of about 20 grams per liter. A bronze color is then obtained.

The coloring of the pores 32 results from a phenomenon of fixing of metal oxide micro-particles on the walls of the pores 32 by an ion exchange mechanism. Parameters such as the diameter and the depth of the pores directly affect the intensity of the coloring: the amplitude of the coloring increases when the number of pores 32 increase and/or when the thickness E1 of the layer increases.

Other methods of coloring may be used. These methods consist, for example, in cathodic deposits in an electrolytic medium. The coloring is then specific to the cations used and, here again, the coloring obtained depends on the metal oxides or the metals deposited.

It may be useful (but not obligatory) in certain cases to close, i.e. to clog, the pores 32 of the dyed alumina layer 20. This could be done, for example to preserve the coloring more efficiently from chemical attack.

Figure 6:
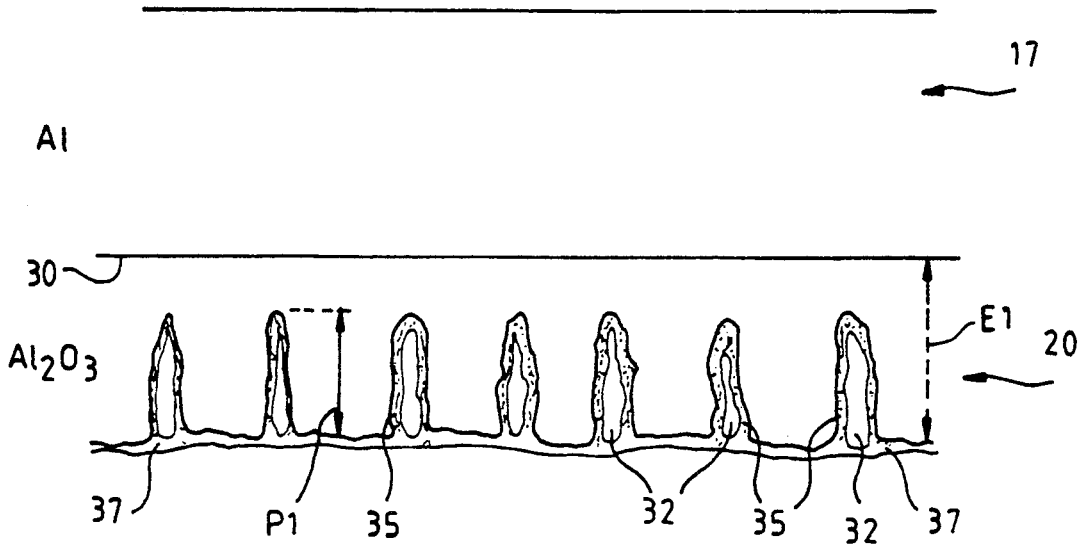
FIG. 6 shows a schematic view of another embodiment of the alumina layer shown in FIG. 3.

FIG. 6 is a view similar to that of FIG. 4, and it illustrates the plugging or "clogging" of the pores 32, this clogging being obtained by an additional treatment carried out after the "coloring" of the pores 32 has been obtained. The "clogging" treatment may consist, for example, of a dip-coating in a highly diluted aqueous solution of nickel salt and cobalt close to boiling point (98° C). The pores 32 are "closed" by means of the growth of an additional alumina layer 37 on the surface.

As mentioned here above, the degree of porosity may be controlled by the density of the anodic current and increases with this current. This property may be used to give the dyed alumina layer 20 greater porosity in its central zone than towards its edges in order to give the absorption by the alumina layer 20 the profile suited to correcting the brightness curve as explained here above. Indeed, since the absorbent substance is deposited in the pores 32, if the quantity of these pores 32 in the central zone of the alumina layer 20 is increased, this central zone is given a greater absorption coefficient than the edges.

Figure 7:
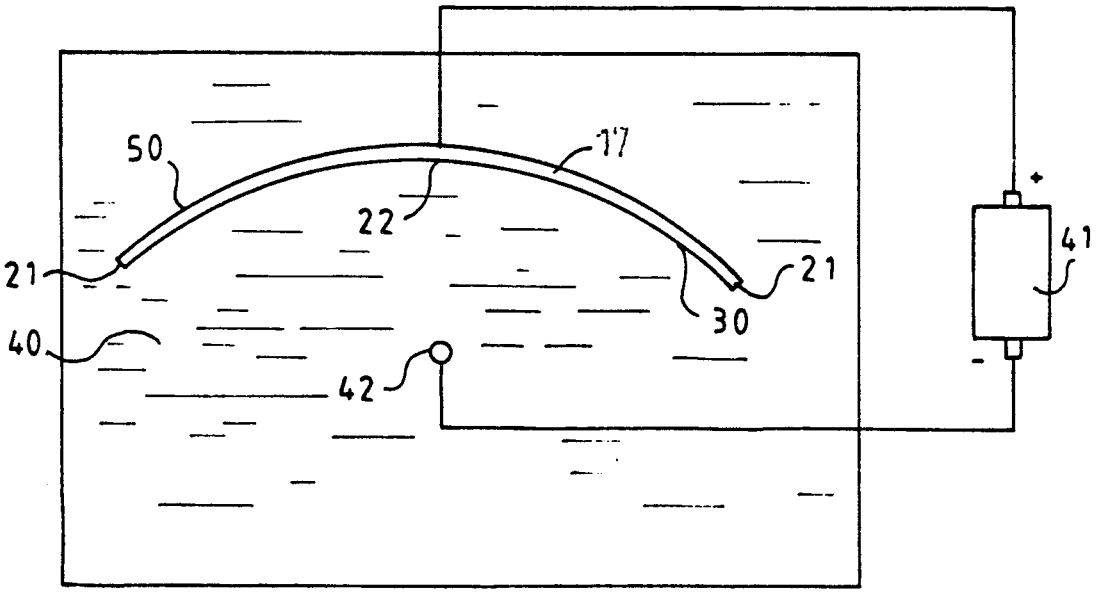
FIG. 7 gives a schematic illustration of how to obtain a gradient of the porosity of the alumina layer shown in FIG. 3.

FIG. 7 gives a schematic view, by way of a non-restrictive example, of how to obtain greater porosity in the central zone 22 than towards the edges 21 of the dyed alumina layer 20, by using an electrolysis cell with ppropriate geometry.

FIG. 7 shows the aluminium substrate 17 in a sectional view similar to that of FIG. 3. The substrate 17 is plunged into an electrochemical solution 40, as referred to here above, capable of giving rise to the formation of the porous alumina layer 20. The substrate is connected to the positive polarity "+" of a current source 41, so that it constitutes the positive electrode of an electrochemical anodization system. The "−" negative polarity of the current source 41 is connected to another electrode 42 forming a cathode with dimensions smaller than those of the anode constituting the substrate 17. The cathode 42 is positioned in the electrochemical solution 40, facing the internal face 30 of the substrate 17 (the external face 50 of the substrate 17 being, for example, protected temporarily by a varnish).

To obtain a porous alumina layer 20, having greater porosity at the center 22 than at its edges 21, the cathode 42 is positioned so that it is closer to the center 20 than to the edges 21. Under these conditions, the intensity of the electrical current is greater between the center 22 and the cathode 42 than between the cathode 42 and the edges 21. The result thereof is an increase in porosity in the direction going from the edges 21 towards the center 20, and hence a greater number of sites for the gripping of the absorbent substance, towards the center 22.

It must be noted that, should the coloring of the alumina layer 20 by the absorbent substance be obtained by a cathode operation, then an equivalent cell geometry may be used (but, naturally, in this case, the substrate 17 would form a cathode) in order to deposit more of the absorbent substance at the center with a view to correcting the brightness curve.

What is claimed is:

1. A radiological input screen for a image intensifier tube, comprising:

a scintillator layer borne by a substrate, a dyed porous layer of alumina interposed between the substrate and the scintillator, the dyed porous alumina layer including a substance that is absorbent at least at a wavelength emitted by the scintillator layer so that light photons emitted by the scintillator layer towards the substrate are at least partially absorbed in the dyed alumina layer.

2. An image intensifier tube according to claim 1, wherein the substrate is made of aluminum.

3. An image intensifier tube according to claim 1, wherein the absorbent substance is at least partially contained in at least a part of the pores of the dyed alumina layer.

4. An image intensifier tube according to any one of claims 1 or 3, wherein the alumina layer is dyed so as to achieve substantially uniform absorption between its edges and its center.

5. An image intensifier tube according to any one of claims 1 or 3, wherein the alumina layer has a substantially uniform porosity between its edges and its center.

6. An image intensifier tube according to any one of the claims 1 or 3, wherein the alumina layer is dyed so as to absorb more at its center than at its edges.

7. An image intensifier tube according to either of the claims 1 or 3, wherein the dyed alumina layer has greater porosity at its center than at its edges.

8. An image intensifier tube according to any one of the claims 1 or 3 wherein the scintillator layer is made of cesium iodide.

9. A method for making an input screen for an image intensifier tube, comprising the steps of:

providing a scintillation layer borne by an aluminum, substrate;

providing a dyed alumina layer between said aluminum substrate and said scintillator wherein the step of providing said alumina layer includes the step of making a porous alumina layer on the substrate by a method for the electrochemical anodization of said aluminum substrate.

10. A method according to claim 9, wherein the electrochemical solution used for the anodization is an acid solution chosen to obtain a porosity of the alumina layer.

11. A method according to claim 10, wherein the alumina layer is given a porosity greater at its center than at its edges.

12. A method according to claim 11, wherein the anodization of the substrate is done by means of a cathode positioned closer to the center than to the edges of the substrate.

13. A method according to claim 9, wherein the alumina layer is dyed by means of metal oxides.

14. A method according to claim 13, wherein a method of dip-coating is used to dye the alumina layer.

15. A method according to claim 13, wherein a method of cathode deposition in an electrolytic medium is used to dye the alumina layer.

* * * * *